US006228001B1

(12) United States Patent
Johnson et al.

(10) Patent No.: US 6,228,001 B1
(45) Date of Patent: May 8, 2001

(54) DEVICE FOR EXERCISING AND STRENGTHENING THE HAND, WRIST AND ARM

(76) Inventors: Ronald B. Johnson, 10921 W. Martin Rd., Casa Grande, AZ (US) 85222; David Hillery, 999 Meadow Glen Dr., Boulder, CO (US) 80303

( * ) Notice: Subject to any disclaimer, the term of this patent is extended or adjusted under 35 U.S.C. 154(b) by 0 days.

(21) Appl. No.: 09/340,627

(22) Filed: Jun. 28, 1999

(51) Int. Cl.[7] ..... A63B 23/16

(52) U.S. Cl. ..... 482/48; 482/44; 482/47; 482/49

(58) Field of Search ..... 482/44, 47, 48, 482/49, 46, 132, 121; 446/46, 48; 573/588; 601/40

(56) References Cited

U.S. PATENT DOCUMENTS 3,612,521 * 10/1971 Wendeborn ..... 272/67
4,828,249 * 5/1989 Keating ..... 272/68
4,929,211 * 5/1990 Resnick et al. ..... 446/14
5,045,011 * 9/1991 Lovik ..... 446/46
5,366,436 * 11/1994 Gibney ..... 601/40
5,536,195 * 7/1996 Stamos ..... 446/48

* cited by examiner

*Primary Examiner*—Jerome W. Donnelly
*Assistant Examiner*—Lori Baker Smith

(57) ABSTRACT

An exercise, strengthening and therapy device for the hand, wrist and arm. An elastomeric disk-like body has a plurality of spaced apart apertures for receiving the thumb and fingers of the user. A convex enlargement extends from at least one surface of the body positioned inward of the apertures. The enlargement may be spherical, semi-spherical or other curved configuration. In use, the device is inserted over the ends of the fingers and the thumb. In a preferred embodiment the device is integral, and in another the components may be disassembled and used separately. Exercise, strengthening and therapy benefits are achieved by flexing the fingers against the elastic resistance of the body and by alternately compressing the elastomeric projection within the palmar surface and fingers.

14 Claims, 6 Drawing Sheets

DEVICE FOR EXERCISING AND STRENGTHENING THE HAND, WRIST AND ARM

FIELD OF THE INVENTION

The present invention relates to a physical therapy device and exercise device and more particularly relates to a device which engages the fingers and thumb of the user's hand allowing the user to alternately extend and close the fingers against elastic resistance in order to exercise the muscles of the hand, wrist and arm for therapy, as well as for increasing strength and flexibility. The device of the invention benefits those engaging in sporting activities and also serves to relieve and prevent conditions such as carpal tunnel syndrom (CTS) and repetitive motion injuries (RMI) such as tennis elbow.

BACKGROUND OF THE INVENTION

Carpal tunnel syndrome and repetitive motion injuries may be a result of a number of factors including arthritis, trauma, stress and overuse which cause irritation or swelling of the tendons. Persons most at risk are those who engage in repetitive motions that impose a continual strain on the hand, wrist and arm such as tasks routinely performed by framers, assembly line workers and office workers operating computer keyboards.

Simple expedients such as exercising the hand and fingers in an opening and closing motion provide therapeutic benefits. Exercising in this manner may also enhance performance in activities such as tennis and golf by increasing strength, flexibility and endurance.

Various hand exercising devices can be found in the prior art for treating conditions resulting from repetitive motion. For example, U.S. Pat. No. 5,366,436 shows a device and method described as useful in treatment of symptoms related to carpal tunnel syndrome. The device comprises an elastic member which removably attaches to the distal tips of the fingers and the thumb of the hand. The individual wears the device and with the fingers and thumb extended, repetitively forces the fingers and thumb outwardly away from one another against the elastic restoring force of the device. The patent neither describes nor suggests a device which provides resistance to squeezing.

U.S. Pat. No. 4,828,249 shows a pocket sized exercising appliance which fits the hand and exercises the wrist, hand and arm muscles. The device has an elastomeric, polygonal body member having a plurality of holes such that can be squeezed and compressed in the hand or stretched with the thumb and fingers in the holes. However, no special feature is suggested that would resist squeezing or compression.

Another device of this type is shown in U.S. Pat. No. 5,062,625. The hand exerciser of the '625 patent is made of a resilient material and has a number of finger-engaging ports each connected to one side of a body portion by bridging segments. The body portion to the side thereof, opposite the finger-engaging ports includes a thumb-engaging port. The hand exerciser may be useful for strengthening the muscles used during the extension of the fingers and movement of the thumb in a generally outwardly direction. The exerciser is preferably made of a one-piece rubber material and can be produced by molding techniques.

U.S. Pat. No. 4,750,734 shows a hand exerciser which has a rigid frame spanned by a resilient web to accommodate the hand which because of its size and rigidity is not conveniently portable and compact.

Thus, while various devices are available in the prior art to exercise and strengthen the hand and fingers, these devices may not be totally effective for the intended use and further are generally useful only for extension. Prior art devices do not provide the function of exercising and building up other parts of the body such as the muscles in the wrist and upper forearm resulting in increased strength, flexibility and endurance providing therapeutic and preventative benefits as well as enhancing athletic performance.

BRIEF SUMMARY OF THE INVENTION

The present invention relates to an exercise device which is small and compact so that it can be carried on the person of the user or be easily stored in a desk drawer, brief case or other work location so that it is available for convenient use. The device is fabricated from an elastomeric material such as natural or synthetic rubber or neoprene. The exercise device may be fabricated by various techniques such as injection molding. The device has a body which has a disk-like web section which is generally circular. A plurality of finger-receiving apertures are arranged about the center of the device with the apertures being spaced apart. The number of apertures may vary with at least five being provided to receive the fingers and thumb of the user. In a preferred embodiment, eight apertures are provided to accommodate various relative positions of the fingers and thumb and also so the device does not have to be oriented to a particular use-position.

In a preferred embodiment, a projection extends from both sides of the device positioned inwardly of the apertures forming a centrally positioned generally convex enlargement. The increased thickness provided by the enlargement provides greater resistance to stretching and deformation and provides the means for actively flexing the fingers inward against compressible resistance to strengthen and exercise the hands and fingers of the user as flexion and extension occurs. Further, in this embodiment, the fingers may be inserted from either side of the device and once inserted, the projection on the side adjacent the hand is aligned with the palm or surface of the hand. This allows the user to perform extension and flexion exercises with the fingers. The user may also grasp the device in a manner so that the central enlargement is engaged against the palmar surface allowing the user to apply further force to compress the device. This configuration, contrasted to prior art devices, serves to both provide resistance to exercise the hand and fingers and also to exercise the areas of the anatomy such as the wrist and forearm and to increase circulation. The enlarged convex portion is compressed and relaxed alternately. In other embodiments, the convex enlargement may project from only one surface of the disk-shaped web which web defines finger and thumb receiving holes or the enlargement may be separable from the disk. The holes may be symmetrical or asymmetrical about the X and Y axes.

BRIEF DESCRIPTION OF THE DRAWINGS

A better and more complete understanding and appreciation of the present invention will be had from the following description, claims and drawings in which:

DETAILED DESCRIPTION OF THE DRAWINGS

Figure 1:
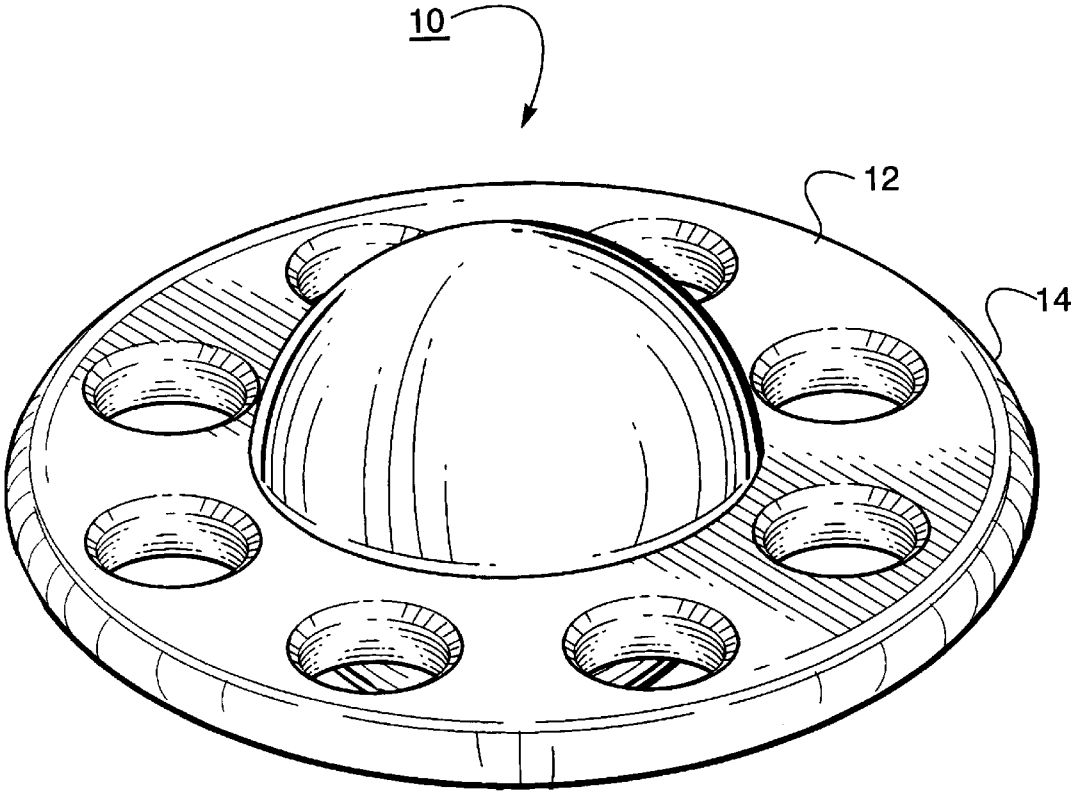
FIG. 1 is a perspective view of the exercising and therapy device of the present invention.
Figure 2:
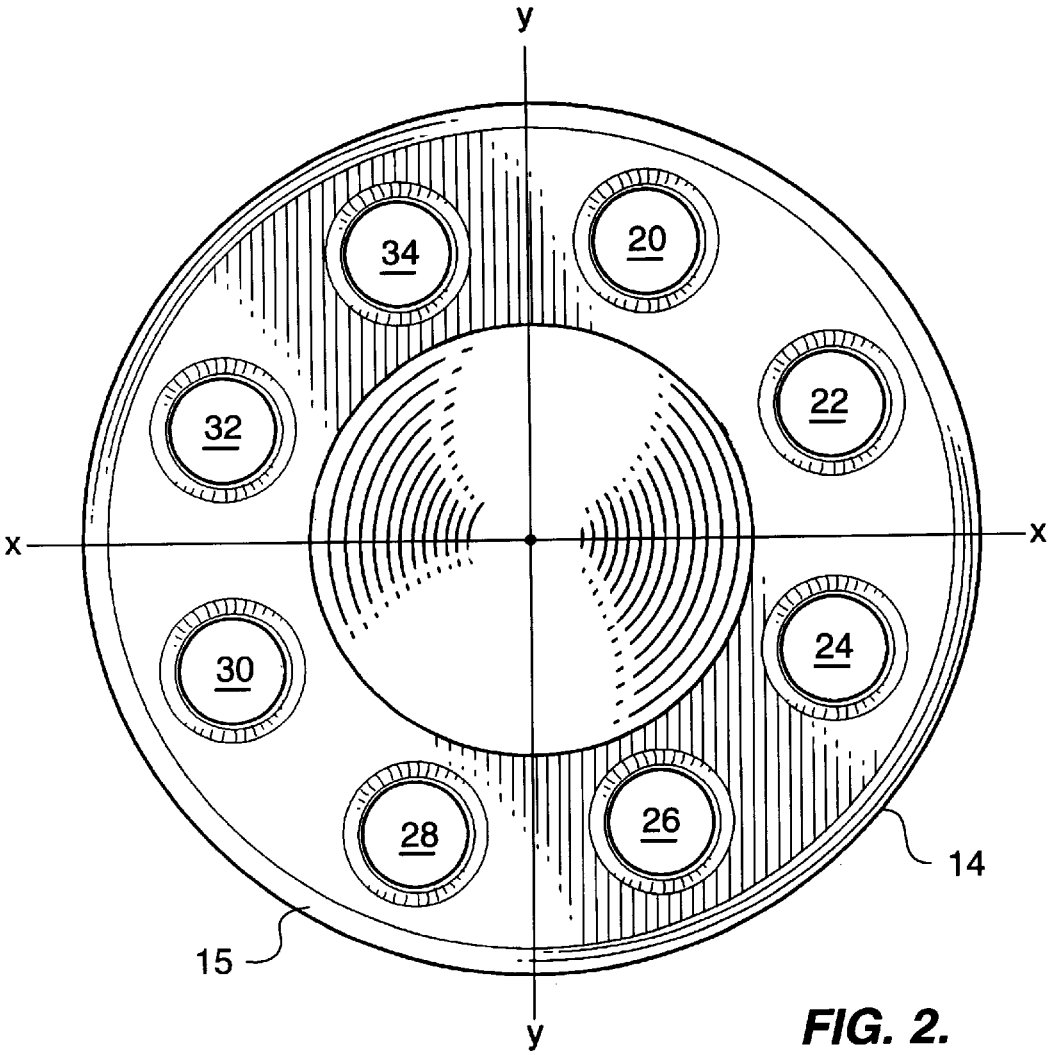
FIG. 2 is a top view of the device of the present invention with the bottom view being identical thereto.
Figure 3:
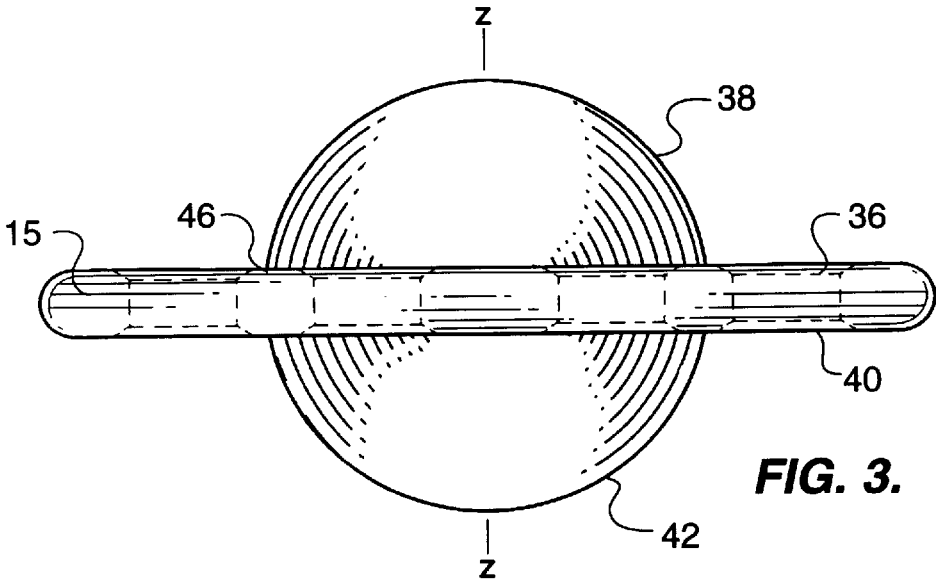
FIG. 3 is a side view of the exercising and therapy device of the present invention in a use-position.

Turning now to the drawings, particularly FIGS. 1 to 3, the exercising and therapy device of the present invention is generally designated by the numeral 10 and has a disk-like body 12 which is shown having a generally circular peripheral edge 14 and opposite surfaces 36 and 40. The center of the body 12 is indicated by the numeral 16. It will be observed that the device of this embodiment is symmetrical about the XX, YY and ZZ axes. A plurality of finger-engaging apertures, 20, 22, 24, 26, 28, 30, 32 and 34 are concentrically located inwardly of the peripheral edge 14. In the drawing figures, eight such apertures are shown, although fewer can be provided. However, for optimal application and adaptability to users having anatomical differences, six or eight such apertures are preferred. Further, by providing an even number of equally spaced apertures, a symmetrical configuration is established which does not require the user to orient the device when placing it in use. The distal ends of the fingers may be inserted into any of the apertures from either side 36 or 40 with the thumb positioned in one of the opposite apertures.

Surface 36 has a generally semi-spherical projection or enlargement 38 extending from the central area of the surface. The opposite surface 40 of the body has a similar semi-spherical projection 42 extending from its center. As best seen in FIG. 3, the projections 38 and 42 define generally a spherical shape although some flaring or curvature is shown in areas such as area 46 where the projections 38, 42 are radiused to meet their respective surfaces 36 and 40. The peripheral edge may be formed having a rim 15 of increased thickness for strength and to provide better resistance to flexure. While the projections 38, 42 are each semi-spherical, they may be almost any convex shape such as the curved shape of the conventional computer mouse.

The device of this embodiment is integrally formed, preferably by fabrication techniques as injection molding and may be manufactured from any suitable elastomeric material such as rubber, silicon rubber, latex, polyurethane or copolymers of these materials. The dimensions of the device may vary although for most applications, a single size is suitable as the anatomical differences in the adult human hand are generally not so great as to require multiple sizes. Further, the elastomeric material of the device stretches and allows use by a range of individuals having anatomical differences. Typically, the diameter of the device will be from about 2.5" to 3.5" and the diameter of the finger-receiving apertures approximately 0.40" to 0.60". Preferably the material is highly elastic, tear resistant having tensile strength of at least 150 psi, elongation of at least 300% (ASTM D-412), and Shore A hardness between 10 and 20.

Figure 4:
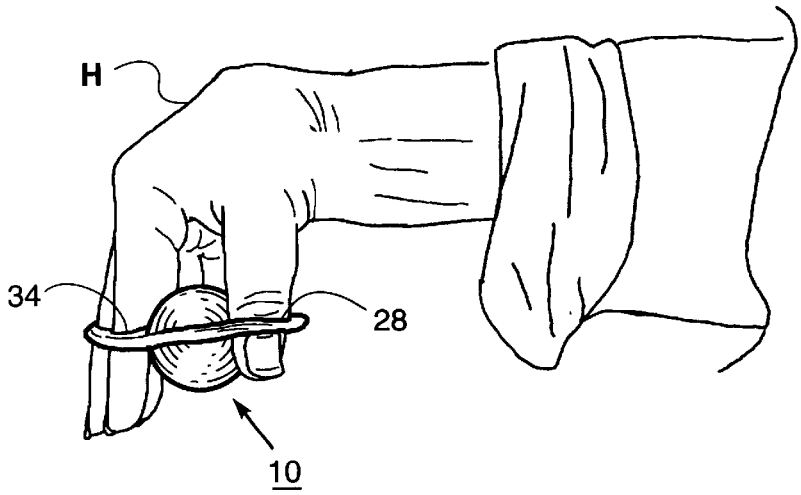
FIG. 4 illustrates the device engaged about the fingers and thumb of the user.
Figure 5:
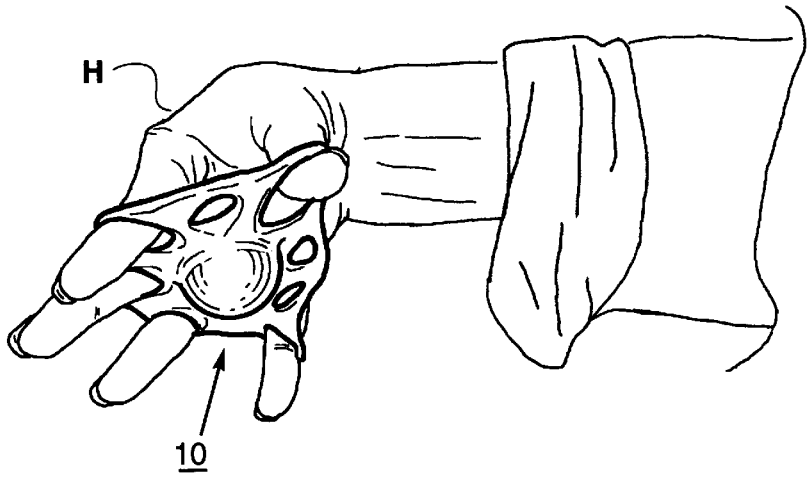
FIG. 5 shows the device with the fingers in an extended position in which the device is expanded or stretched.
Figure 6:
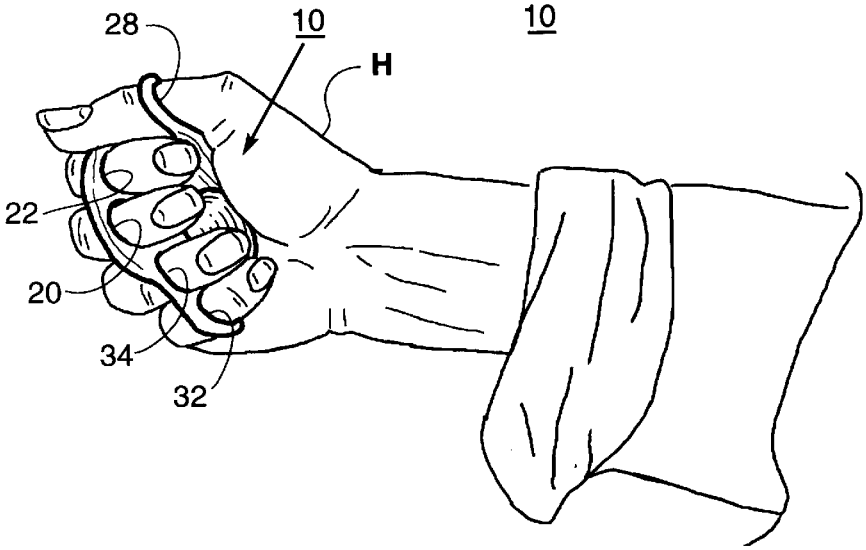
FIG. 6 shows the device in a compressed condition in the palm and fingers of the hand of the user.

Turning to FIGS. 4 to 6, use of the device is illustrated. A hand "H" of an individual is shown in connection with the device 10. It will be noted the individual has inserted a thumb in one of the apertures, as for example aperture 28 and the four fingers have been inserted in generally diametrically opposed apertures such as apertures 20, 22, 24 and 34. Since there are additional apertures, such as apertures 30, 32 and 24, the user may position the thumb relative to the fingers in various positions depending upon the therapy required and the anatomy of the individual's hand. Also, it is to be noted that since the device is symmetrical, it can be easily engaged over the ends of the fingers and the thumb of the individual without the individual having to orient the device by selecting a right side or a particular position.

In FIGS. 4 to 6, the individual is shown performing repetitive exercises in which the fingers and the thumb are flexed and extended against the resistive elastic force imposed by the device. This simple exercise of flexion and extension performed periodically can bring relief from discomfort and stiffness and some symptoms of carpal tunnel syndrome. Further, by periodically performing such operation during the course of a work day in which the work involves repetitive motion, the exercise can help to not only alleviate but prevent the symptoms from initially occurring.

The device may also be used as a device which is held in the palmar surface to not only strengthen the hand and fingers but also to exercise and strengthen the upper forearm, particularly in the area of the extensors and flexors of the hands and wrist.

In FIG. 6 the user's hand "H" is shown compressing the device 10 and it will be seen that at least part of the spherical portion defined by projections 38 and 42 is engaged against the palm of the user's hand. Thus, the user can alternately open and close the hand compressing and extending the device for exercise and therapy. These exercises strengthen the muscles of the hand, wrist and forearm and may help to improve performance and avoid injury in certain sports such as golf and tennis.

Figure 7:
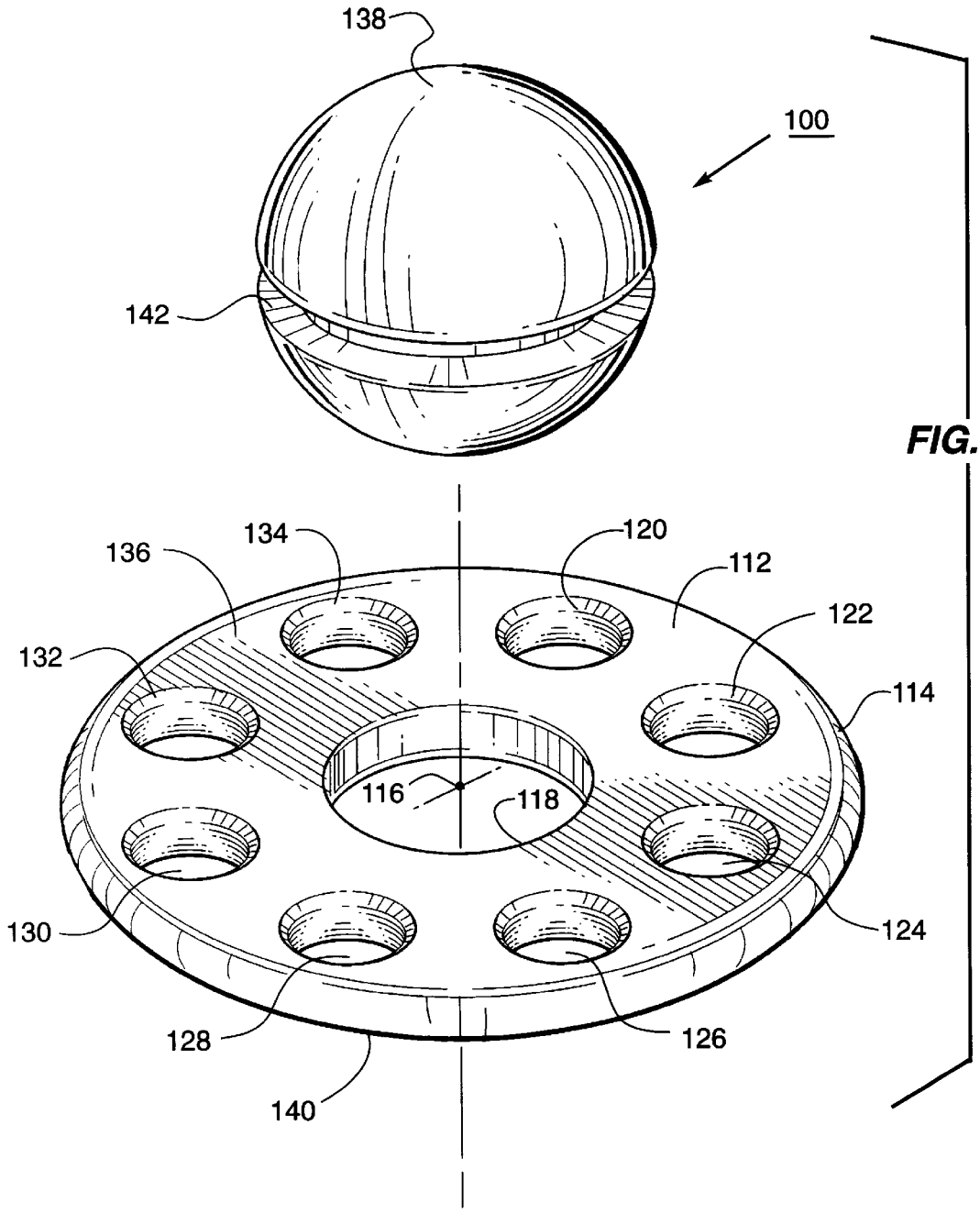
FIG. 7 is an exploded perspective view of an alternate embodiment of the exercise device of the present invention.

FIG. 7 shows another embodiment of the present invention which is generally designated by the numeral 100. In the assembled position, the embodiment 100 is similar to that shown in FIGS. 1 to 3. However, as has been previously described, the embodiment 10 of FIGS. 1 to 3 is molded or fabricated as a single integral unit. In the embodiment 100 of FIG. 7, the device has a body which comprises a general spherical component 138 and a disk member 112. The disk 112 is generally circular having an outer peripheral edge 114 and opposite surfaces 136 and 140. The center of disk 112 is indicated by axis 116. A plurality of finger-engaging apertures 120, 122, 124, 126, 128, 130, 132 and 134 are equally spaced inward of the peripheral edge 114 with their centers being on a circle concentric about 116. The number of apertures may vary, preferably with five being minimum and eight apertures being maximum for best performance.

Spherical member 138 defines a circumferential groove 142. Groove 142 is sized and arranged so that the central opening 118 in the disk member may be snugly engaged within the circumferential groove 142 accommodated by the elasticity of the components. In the assembled position, semispherical sections project convexly from the opposite surfaces 136 and 140 of the disk 112. When the sphere and disk are assembled as a unit, the device 100 is configured similar to that shown in FIGS. 1 and 2. The material of the spherical component 138 and the disk component 140 are again selected from materials having the characteristics described above.

The advantage forming the device 100 as two components results in certain economies of manufacturing as fabricating the sphere 138 and the disk 112 separately may reduce manufacturing costs. Further, if the two components are not permanently secured together by adhesive but rather held together by frictional and elastic forces, the user may separate the components using them independently of one another. For example, the sphere 138 can be separated from the disk 112 and independently held in the palm for flexion exercises. Similarly, the disk can be used for extension exercises by inserting the thumb and fingers in selected of the apertures as has been described previously.

Figure 8:
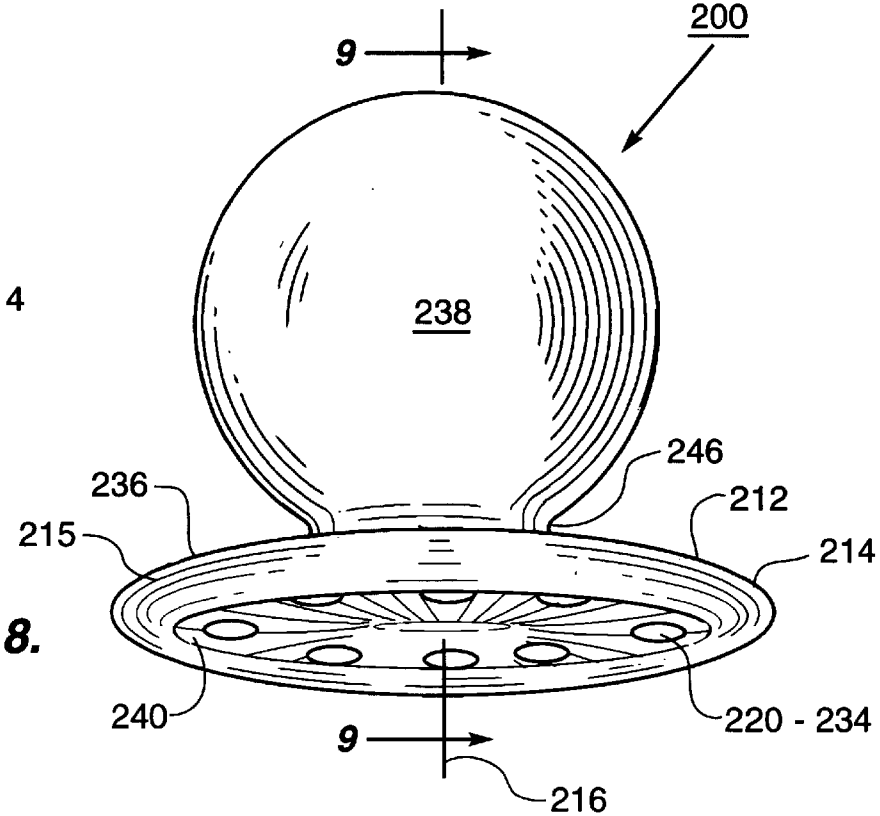
FIG. 8 is a perspective view of yet another embodiment of the device of the present invention.
Figure 9:
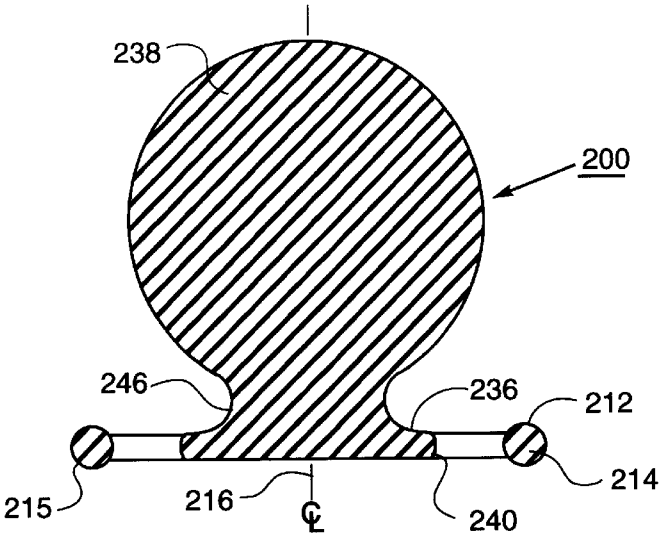
FIG. 9 is a sectional view taken along line 9—9 of FIG. 8.

Turning now to FIGS. 8 and 9, yet another embodiment of the invention is shown which is generally designated by the numeral 200. The exercising device 200 has a body 212 which is shown as generally circular disk 212 having an outer peripheral edge 214 and opposite surfaces 236 and 240. The center axis of the disk is indicated by the numeral 216. A plurality of finger-engaging apertures 220, 222, 224, 226, 228, 230, 232 and 234 are located inwardly of the peripheral edge 214 and are equally spaced apart with their centers on a circle concentric with respect to axis 216. Again, any number of apertures can be provided but from five to eight apertures are preferred for optimal use. Since an even number of apertures are provided, a symmetrical configuration is established which does not require the user place the device in a particular orientation when the device is used.

A generally spherical projection 238 extends from side 236. The general spherical projection is connected to surface 236 at transition area 246. A rim 215 may be formed about one periphery providing increased thickness for strength and durability. The embodiment 200 is formed preferably by fabrication techniques such as injection molding and may be manufactured from any suitable elastic material such as rubber, silicon rubber, latex, polyurethane or copolymers of these materials, preferably having characteristics as described above. Again, the size of the device may vary somewhat but the dimensions will be selected to comfortably conform to the human hand. The device is suitable for flexion and extension exercises of the hand and the spherical enlargement 238 may be compressed and allowed to expand within the palm of the hand to strengthen the muscles and tendons in the forearm.

Figure 10:
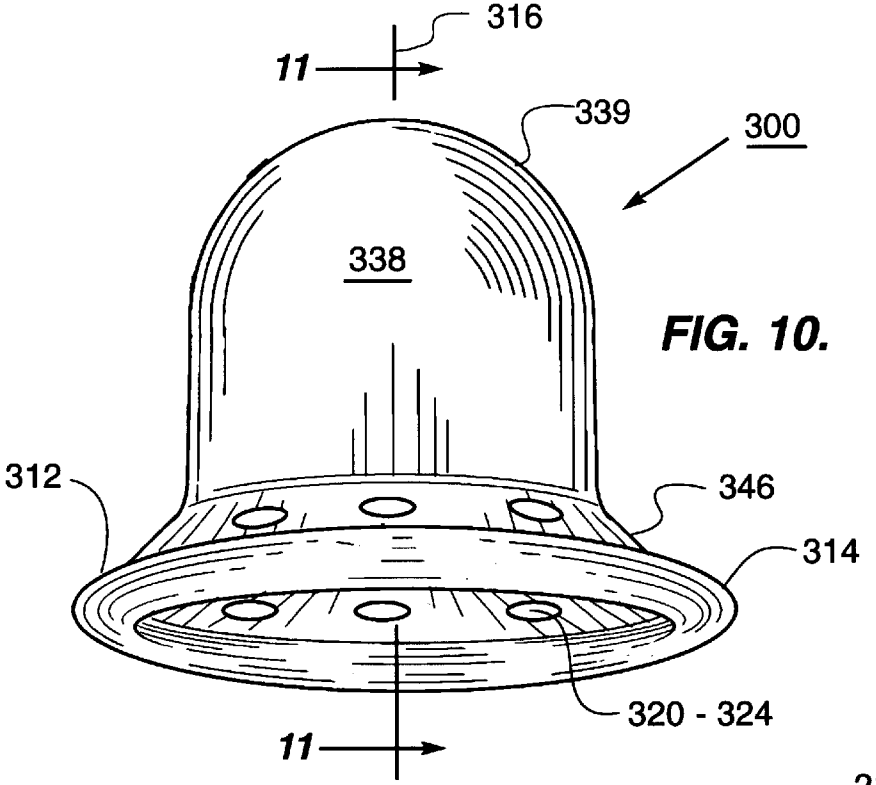
FIG. 10 is a perspective view of yet another embodiment of the present invention.
Figure 11:
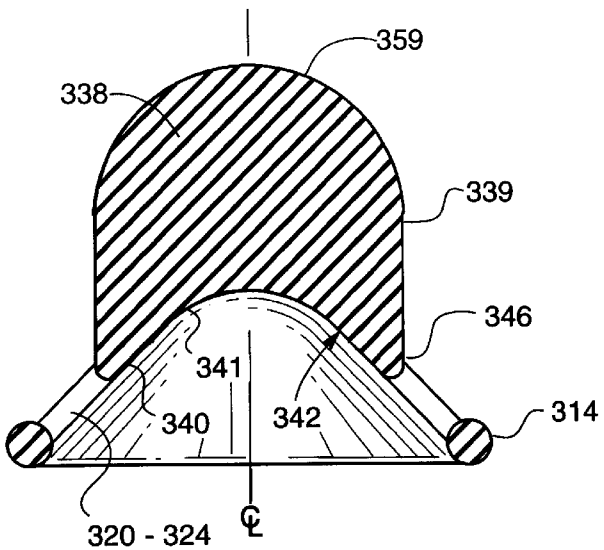
FIG. 11 is a sectional view taken along line 11—11 of FIG. 10.

In FIGS. 10 and 11 yet another embodiment is shown which is designated by the numeral 300. Embodiment 300 has an integrally formed projection 338 which has cylindrical section 339 with a dome or semispherical portion 359 at its upper end. The lower end of the cylindrical section 339 flares at a skirt portion 346 which flares somewhat outwardly to a peripheral rim or edge 314. The edge 314 may be of somewhat increased thickness for strength and durability. As best seen in FIG. 11, the lower surface 340 has an interior concave section 342.

A plurality of apertures 320 to 324 extend circumferentially around the skirt portion. Preferably the apertures number from between five to eight and are arranged with their centers on a circle concentric about axis 316. The material and fabrication of the embodiment shown in FIGS. 10 and 11 is as generally has been described above. The device 300 may be used as described for flexion and extension of the fingers and compression within the palm to achieve the benefits discussed above.

Figure 12:
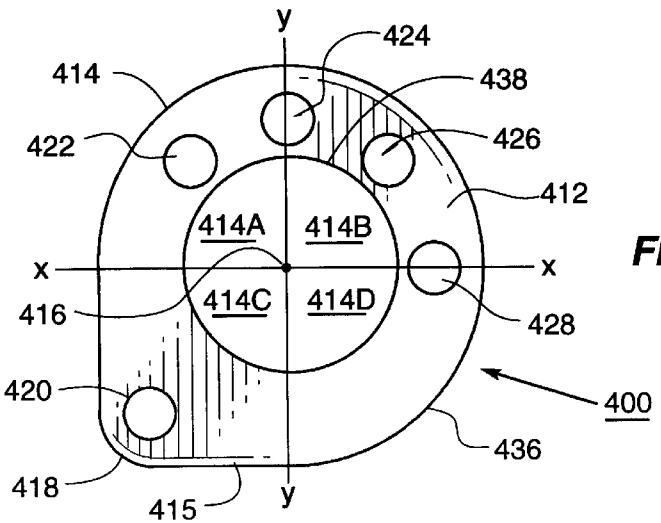
FIG. 12 is a top view of still another embodiment of the invention showing an alternate arrangement for the finger and thumb receiving apertures.

FIG. 12 shows yet another embodiment of the invention generally designated by the numeral 400. FIG. 12 is a top view of the device 400. Device 400 is a hand-held device suitable for performing for both exercise, strengthening and therapy of the hand and forearm. The device 400 has a body 412 which has an outer peripheral edge 414 which is shown as being generally circular in quadrants 414A, 414B, 414C. In quadrant 414C, the peripheral edge has linear edges 415 and 416 which are generally disposed at right angles with respect to one another with curved section 418. An enlargement 438 projects from the body 412. The projection 438 may be semispherical, as shown in FIG. 8, or more dome-like, as shown in FIG. 10. The enlargement may also be a spherical projection extending from the surface 440, as well as opposite surface 436. The peripheral edge may be of increased cross section for increased durability. The device may be integrally molded as a single piece or made from separate components which are assembled into a single unit as shown with reference to FIGS. 7 and 8. The materials of construction will be suitable elastomeric materials having the characteristics described above.

The arrangement of the apertures for receiving the fingers and thumb of the user are asymmetrical in the embodiment shown in FIG. 12. A thumb receiving aperture 420 is provided in the web of the body in quadrant 414C. A plurality of apertures 422, 424, 426 and 428 are provided generally opposite aperture 420. Apertures 422, 424, 426 and 428 are preferably equally spaced having their centers on a circle concentric with the center 416.

In use, the device 400 is grasped by the user with the user placing his or her thumb in aperture 420 and fingers would be oppositely disposed in apertures 422, 424, 426 and 428. Again, the user may perform a series of flexion and extension manipulations for both therapy and exercise to resist fatigue and strengthen the muscles of the hand and forearm.

Alternating flexions and extensions greatly increases the number of repetitions the user is able to perform. Compression and release of the center enlargement or dome 438 can also be performed mainly to strengthen the tendons and muscles in the forearm. The various embodiments described with reference to FIGS. 1 to 11 may also be provided with the asymmetrical thumb and finger hole arrangement shown in FIG. 12.

The various embodiments of the invention described herein provide numerous benefits. By exercising and strengthening the hand, wrist and forearm certain conditions resulting from repetitive motion may be avoided or alleviated. Flexion and extension of the fingers and compression and expansion of the hand results in increased blood flow, reduces fatigue. Also less tangible psychological benefits derive from the fact that the exercises are pleasurable and soothing.

It will be obvious to those skilled in the art to make various changes and modifications to the invention described herein. To the extent these various changes and modifications do not depart from the spirit and scope of the appended claims, they are intended to be encompassed therein.

We claim:

1. A hand-held exercising, therapy and strengthening device for the hand, wrist and arm comprising:

(a) a body having a center and having opposite first and second surfaces and defined by a peripheral edge;

(b) a plurality of apertures in the body, said apertures being spaced apart inwardly of the edge and sized to accommodate the fingers and thumb of a user;

(c) a first generally convex enlargement centrally extending from the first surface, spaced inward of said plurality of apertures, said body and enlargement being an elastomeric material whereby the fingers and thumb of the user may be inserted in said apertures and the body deformed outwardly by spreading the fingers and thumb and the body compressed by squeezing the body within the palm area of the user's hand to achieve exercise, therapy and strengthening benefits.

2. The exercising, strengthening and therapy device of claim 1 wherein the apertures are concentrically arranged about said body.

3. The exercising, strengthening and therapy device of claim 1 wherein said device is fabricated from an elastomeric material having an elongation of at least 300%.

4. The exercising, strengthening and therapy device of claim 1 wherein a second generally convex enlargement extends from the second surface of said body spaced opposite said first enlargement.

5. The exercising, strengthening and therapy device of claim 1 wherein said body has a diameter of approximately 2.5" to 3.5" and said apertures have a diameter of approximately 0.4" to 0.6".

6. The exercising, strengthening and therapy device of claim 1 wherein said body is symmetrical with respect to the X—X, Y—Y and Z—Z axes.

7. The exercising, strengthening and therapy device of claim 1 wherein said body is a generally disc shaped member.

8. The exercising, strengthening and therapy device of claim 1 wherein said body and said enlargement are integrally formed.

9. The exercising, strengthening and therapy device of claim 1 wherein said body and said enlargement are separable components which are engageable and disengageable from one another.

10. The exercising, strengthening and therapy device of claim 1 wherein the apertures are non-concentrically arranged on said body.

11. The exercising, strengthening and therapy device of claim 1 wherein said convex enlargement is generally semi-spherical.

12. The exercising, strengthening and therapy device of claim 1 wherein said convex enlargement is generally spherical.

13. The exercising, strengthening and therapy device of claim 1 wherein said second surface is generally convex.

14. A hand-held exercising, therapy and strengthening device for the hand, wrist and arm comprising:

(a) an elastomeric body having a center and a peripheral edge and having opposite first and second surfaces;

(b) a plurality of finger-receiving apertures in the body being spaced apart and extending partially around the periphery of the body;

(c) a thumb-receiving aperture in the body generally opposite said plurality of finger-receiving apertures; and (d) a first generally convex enlargement centrally extending from the first surface, spaced inward of said plurality of apertures whereby the fingers and thumb of the user may be inserted in said apertures and the body deformed outwardly by spreading the fingers and thumb and the body compressed by squeezing the body within the palm area of the user's hand to achieve exercise, therapy and strengthening benefits.

* * * * *